US006633127B2

(12) United States Patent
Vos et al.

(10) Patent No.: US 6,633,127 B2
(45) Date of Patent: Oct. 14, 2003

(54) HIGH-PRESSURE DISCHARGE LAMP HAVING CONSTRUCTION FOR PREVENTING BREAKDOWN

(75) Inventors: Theodorus Petrus Cornelis Maria Vos, Eindhoven (NL); Martinus Joseph Maria Kessels, Eindhoven (NL); Maria Louisa Renders, Kasterlee (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 367 days.

(21) Appl. No.: 09/734,075

(22) Filed: Dec. 11, 2000

(65) Prior Publication Data

US 2001/0015624 A1 Aug. 23, 2001

(30) Foreign Application Priority Data

Dec. 14, 1999 (EP) ..... 99204293

(51) Int. Cl.[7] ..... H01J 17/44; H01J 61/54

(52) U.S. Cl. ..... 313/594; 313/607; 313/635

(58) Field of Search ..... 313/594, 570, 313/25, 27, 634, 595, 596, 601, 607, 635, 636, 638, 3, 249, 268, 285, 571, 576, 623; 315/59, 60

(56) References Cited

U.S. PATENT DOCUMENTS 5,563,474 A 10/1996 Wessels et al. ..... 315/248
5,811,933 A 9/1998 Van Den Nieuwenhuizen et al. .. 313/570
5,942,840 A * 8/1999 Steere et al. ..... 313/25
5,990,599 A * 11/1999 Jackson et al. ..... 313/25
6,392,343 B1 * 5/2002 Luijks et al. ..... 313/570

FOREIGN PATENT DOCUMENTS

| | | |
|---|---|---|
| EP | 0313027 A2 | 10/1988 |
| WO | WO9802902 | 1/1998 |
| WO | WO9931709 | 12/1998 |

* cited by examiner

*Primary Examiner*—Jay Patidar

(57) ABSTRACT

The high-pressure discharge lamp comprises a discharge vessel provided with a first and a second lamp electrode, an outer envelope which surrounds the discharge vessel with space and which is provided with a lamp cap. A tube-like UV enhancer having a longitudinal axis is provided in the space having a ceramic wall and provided with an internal enhancer electrode connected to the first lamp electrode and by way of a capacitive coupling connected to the second lamp electrode, and which enhancer electrode has an end inside the enhancer. The capacitive coupling is formed by a metal curl positioned around the UV enhancer in a plane perpendicular to the longitudinal axis of the UV enhancer and close to the end of the enhancer electrode. The lamp shows on ignition with a relative small ignition voltage only a very small ignition delay.

7 Claims, 1 Drawing Sheet

HIGH-PRESSURE DISCHARGE LAMP HAVING CONSTRUCTION FOR PREVENTING BREAKDOWN

FIELD OF THE INVENTION

The invention relates to a high-pressure discharge lamp comprising a discharge vessel provided with a first and a second lamp electrode, an outer envelope surrounding the discharge vessel with an interspace and having a lamp cap, and a tubular UV enhancer located in the interspace and having a longitudinal axis, said UV enhancer having a wall of ceramic material and being provided with an internal enhancer electrode connected to the first lamp electrode and a capacitive coupling connected to the second lamp electrode, the enhancer electrode having an extremity which is situated within the UV enhancer.

BACKGROUND OF THE INVENTION

A known problem in high-pressure discharge lamps in general is the ignition of these lamps. Dependent on the type of lamp, a relatively high ignition voltage is required, which is generally supplied in the form of one or more ignition voltage pulses to the lamp by a starter. In practice, there may be an inadmissibly long ignition time, even when the ignition voltage pulses are sufficiently high, while furthermore a large spread of this ignition delay is obtained. This is the result of a shortage of primary electrons in the discharge vessel, introducing the lamp discharge during ignition. By adding a small quantity of 85Kr in the discharge vessel, the shortage of primary electrons can be eliminated so that the ignition time will become shorter and its spread is reduced. 85Kr has the drawback that it is radioactive, and its use can be avoided by using an UV enhancer. This is a relatively small discharge vessel that produces UV radiation and is placed in the proximity of the discharge vessel of the lamp. When the lamp is ignited, the UV radiation emitted by the UV enhancer ensures that there are sufficient primary electrons in the discharge vessel of the lamp.

A lamp of the type described in the opening paragraph is known from WO 98/02902. The known lamp is a high-pressure discharge lamp, more particularly a metal halide lamp. This lamp has a discharge vessel with two lamp electrodes. The material of the discharge vessel may be quartz glass or a ceramic material. In this description and the claims, a ceramic material is understood to mean a densely sintered polycrystalline metal oxide, such as aluminum oxide or yttrium aluminum garnet, or a densely sintered polycrystalline metal nitride such as aluminum nitride. An outer envelope supporting a lamp cap surrounds the discharge vessel. The space between the discharge vessel and the outer envelope accommodates an UV enhancer, which has a wall of ceramic material and is provided with an enhancer electrode, which is connected to a first lamp electrode, and with a capacitive coupling. This capacitive coupling is realized by placing the UV enhancer in the proximity of a supply wire to a second lamp electrode. The use of a capacitively coupled UV enhancer as compared with an enhancer with two internal electrodes has the advantage that the enhancer is only operative when this is necessary, namely when ignition voltage pulses having a relatively high voltage and a high frequency are presented. Consequently, the enhancer does not consume energy during operation of the lamp and thus has a very long lifetime.

The use of a ceramic material for the wall of the UV enhancer has a favorable influence on the ignition behavior of the lamp, because the UV radiation generated by a ceramic UV enhancer appears to considerably increase the possibility of introducing the lamp discharge (lamp breakdown). However, the known lamp has the drawback that the UV enhancer itself may have an unacceptably high ignition delay, particularly when the lamp with the UV enhancer has been in the dark for some time. This leads to an unacceptable ignition delay of the lamp and to a large spread of the ignition time of the lamp.

SUMMARY OF THE INVENTION

It is an object of the invention to provide measures of eliminating the above-mentioned drawback. According to the invention, a high-pressure discharge lamp of the type described in the opening paragraph is characterized in that the capacitive coupling is constituted by a metal curl surrounding the UV enhancer in a plane transverse to the longitudinal axis of the UV enhancer and being situated in the proximity of the extremity of the enhancer electrode within the UV enhancer.

It has been found that a very satisfactory capacitive coupling of the UV enhancer is obtained by placing a metal curl around the wall of the enhancer and by connecting this curl to the second lamp electrode. The metal curl must be situated in the proximity of the extremity of the enhancer electrode within the UV enhancer. Due to the eminent capacitive coupling of the UV enhancer in a lamp according to the invention, the possibility of breakdown of the lamp when using ignition pulses considerably increases, while furthermore the height of the ignition pulses, which is minimally required for a reliable ignition, may be relatively small.

Lamps according to the invention are preferred, in which the distance between the extremity of the enhancer electrode within the UV enhancer and the plane in which the metal curl is situated is at most equal to the external diameter of the UV enhancer. In such lamps, the capacitive coupling of the UV enhancer is in fact optimal, particularly if said extremity of the enhancer electrode is situated in the plane of the metal curl, so that the metal curl is minimally spaced apart from the electrode extremity.

In a preferred embodiment, the UV enhancer has a wall of densely sintered polycrystalline aluminum oxide. This material is often used in the manufacture of high-pressure discharge lamps, so that an existing technology for ceramic discharge vessels can be employed, allowing miniaturization within strict tolerance limits.

A very advantageous embodiment of a lamp according to the invention, in which the enhancer electrode has a lead-through at a first extremity of the UV enhancer, is characterized in that the extremity of the enhancer electrode within the UV enhancer is spaced apart from the first extremity of the UV enhancer by a distance which is at least equal to twice the external diameter of the UV enhancer. In such a construction, the possibility of an unwanted breakdown between the metal curl and the lead-through to the enhancer electrode is very small when ignition pulses are supplied.

A combination of mercury and a rare gas is possible as a filling for the UV enhancer. However, a rare gas or a mixture of rare gases is preferred, because this precludes the use of the heavy metal mercury. Very satisfactory results are obtained when using argon as a filling for the UV enhancer. The filling pressure of the rare gas filling is then preferably chosen to be in the range from 50 to 300 mbar. At pressure values of less than 50 mbar, the UV output of the enhancer appears to become smaller; at pressure values of more than 300 mbar, the ignition voltage of the enhancer may assume too high values.

In a further preferred embodiment of a lamp according to the invention, the UV enhancer is situated in the proximity of a lamp electrode, with its longitudinal axis being substantially parallel to the longitudinal axis of the lamp. In this embodiment, it is achieved that a maximal quantity of the UV radiation generated in the enhancer directly impinges upon the lamp electrode, which is favorable for generating secondary electrons in the lamp.

These and other aspects of the invention are apparent from and will be elucidated with reference to the embodiments described hereinafter.

DETAILED DESCRIPTION OF THE PREFERRED EMBODIMENTS

Figure 1:
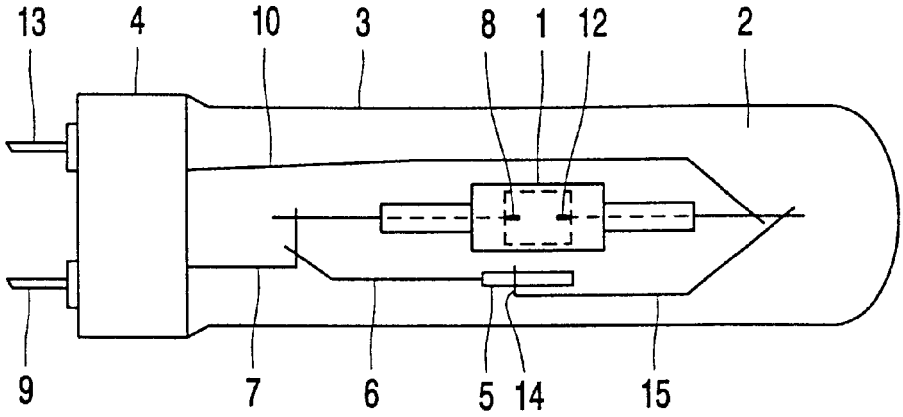
FIG. 1 is a side elevation of a lamp according to the invention.

FIG. 1 shows a high-pressure metal halide lamp comprising a discharge vessel 1 surrounded with an interspace 2 by an outer envelope 3, which supports a lamp cap 4. The discharge vessel 1 is made of densely sintered polycrystalline aluminum oxide and has a first lamp electrode 8 and a second lamp electrode 12, which electrodes are connected to contacts 9 and 13 on the lamp cap 4 by means of current supply wires 7 and 10, respectively. The lamp is provided with an UV enhancer 5, which is situated in the interspace 2. The UV enhancer has an internal enhancer electrode (not shown here; see 42 in FIG. 2) which is connected to the first lamp electrode 8 by means of a lead-through wire 6. The UV enhancer has a capacitive coupling with the second lamp electrode 12. This coupling is constituted by a metal curl 14, which is connected to the second lamp electrode 12 through a conductor 15.

Figure 2:
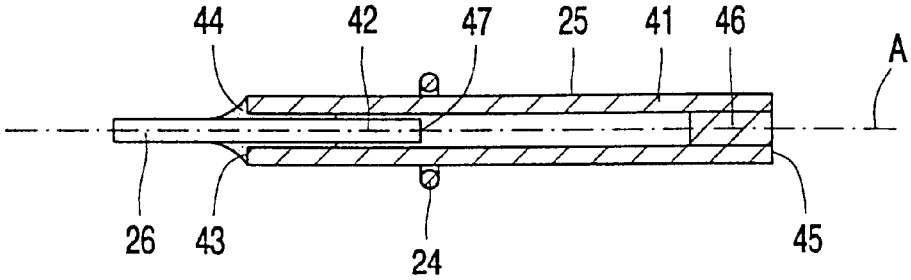
FIG. 2 shows the UV enhancer of the lamp of FIG. 1 in greater detail.

FIG. 2 shows the UV enhancer with a longitudinal axis A, of the lamp of FIG. 1, in a cross-section and in greater detail. The wall 41 of the enhancer 25 is made of a ceramic material. In a practical embodiment, this wall is made of a densely sintered polycrystalline aluminum oxide. The enhancer is provided with an enhancer electrode 42 having a lead-through 26 at a first extremity 43 of the enhancer, which lead-through is intended to be connected to a first lamp electrode. The lead-through 26 is connected in a vacuum-tight manner to the wall 41 by means of a melt glass 44. At a second extremity 45, the enhancer is sealed in a vacuum-tight manner by means of a sintered plug 46. A metal curl 24 intended to be connected to a second lamp electrode surrounds the UV enhancer 25 in a plane transverse to the longitudinal axis A of the enhancer. To obtain a suitable capacitive coupling, the metal curl 24 must be situated in the proximity of the extremity 47 of the enhancer electrode 42 within the UV enhancer. The distance between the extremity 47 and the plane in which the curl 24 is situated is preferably at most equal to the external diameter of the UV enhancer. In the embodiment shown in FIG. 2, the extremity 47 is situated substantially in the plane of the curl 24. The UV enhancer 25 has a length of 13 mm, an external diameter of 1.5 mm and an internal diameter of 0.675 mm. The electrode 42 and the lead-through 26 constitute one assembly of Nb wire with a diameter of 0.62 mm. The electrode extremity 47 is spaced apart from the first extremity 43 of the enhancer by a distance of 4.5 mm. This 4.5-mm distance is larger than twice the external diameter (1.5 mm) of the enhancer. This minimizes the possibility of breakdown between the metal curl 24 and the lead-through 26. The metal curl 24 is formed as a single turn of Nb wire having a wire diameter of 0.72 mm. It is possible to form the curl in a multiple turn, but this does not yield extra advantages. The UV enhancer 25 is filled with argon having a filling pressure of 150 mbar.

Figure 3:
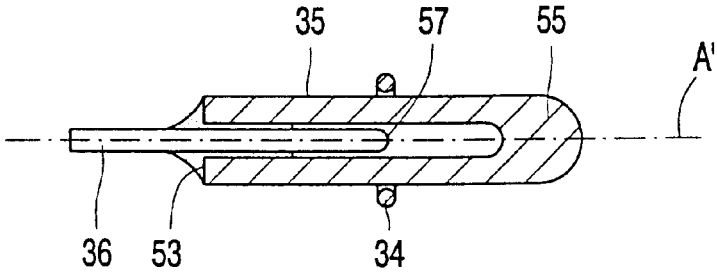
FIG. 3 shows a further embodiment of an UV enhancer of a lamp according to the invention.

FIG. 3 shows a further embodiment of an UV enhancer of a lamp according to the invention. The UV enhancer 35, with longitudinal axis A', has a wall of densely sintered polycrystalline aluminum oxide and a melt glass-fused niobium enhancer electrode 36 at a first extremity 53. The electrode 36 has an internal extremity 57 at a distance of 2.9 mm from the first extremity 53. The UV enhancer 35 has a second extremity 55 in the form of a pinch. A metal curl 34, which is intended to be connected to a second lamp electrode, surrounds the UV enhancer 35 in a plane transverse to the longitudinal axis A' of the enhancer. The enhancer 35 has a length of about 9 mm, an external diameter of 2.45 mm and an internal diameter of 0.75 mm and is filled with argon.

A number of lamps having a construction as shown in FIG. 1 was subjected to an ignition test. These were 7 CDM lamps (Philips) with a power of 35 W (T35W) and 7 CDM lamps (Philips) with a power of 70 W (T70W). As is shown in FIG. 1, the UV enhancer in these lamps is situated in the proximity of a lamp electrode, with its longitudinal axis parallel to the longitudinal axis of the lamp. The lamp electrode is thereby directly irradiated by the UV radiation generated in the enhancer. The lamps were connected to a power supply source of 220 V, 50 Hz via a stabilization ballast provided with an ignition circuit. The ignition circuit comprises a starter, type SN57 (Philips), with a capacitor being arranged parallel to the lamp, so that ignition pulses having a maximum value of 1.8 kV and a pulse width of 7 $\mu$s are supplied. The ignition pulses are supplied to the lamp electrode that is connected to the enhancer electrode. The UV output of the enhancer was then found to be optimal. Prior to the ignition test, the lamps were operated for 10 to 15 minutes and subsequently switched off and maintained in a dark room for at least 1.5 hours. The test was performed at various instants during the lifetime of the lamps (0, 100, 1000, 2000, 4000 hrs). All lamps ignited after an ignition time that was well within the requirement of 30 s. The following Table states the results of the tests. The heading 'av' denotes the average ignition time (in s) of each batch of 7 lamps, and 'max' denotes the maximal ignition time (in s) that was found in the 7 lamps. Ignition times smaller than 0.1 s are denoted by '0' in the Table.

| | 0 hr | | 100 hrs | | 1000 hrs | | 2000 hrs | | 4000 hrs | |
|---|---|---|---|---|---|---|---|---|---|---|
| | av | max | av | max | av | max | av | max | av | max |
| 5W | 0.6 | 5 | 0.1 | 1 | 0.3 | 1 | 0.2 | 1 | 0.2 | 1 |
| T70W | 0.2 | 2 | 0 | 0 | 0 | 0 | 0 | 0 | 1.2 | 12 |

It is clearly apparent that there was only a very small ignition delay at relatively low ignition voltage pulses (1.8 kV). Furthermore, the spread of this ignition delay appeared to be very small.

Comparable results were obtained with lamps provided with an UV enhancer having a construction as shown in FIG. 3.

The protective scope of the invention is not limited to the embodiments described. The invention resides in each and every novel feature and each and every combination of features. Reference numerals in the claims do not limit their protective scope. Use of the verb "comprise" and its conjugations does not exclude the presence of elements other than those stated in the claims. Use of the article "a" or "an" preceding an element does not exclude the presence of a plurality of such elements.

What is claimed is:

1. A high-pressure discharge lamp comprising:

a discharge vessel provided with a first and a second lamp electrode, an outer envelope surrounding the discharge vessel with an interspace and having a lamp cap, and a tubular UV enhancer located in the interspace and having a longitudinal axis, said UV enhancer having a substantially uniform diameter and only a wall of ceramic material, said UV enhancer being provided with an internal enhancer electrode connected to the first lamp electrode and with a capacitive coupling connected to the second lamp electrode, the enhancer electrode having an extremity which is situated within the UV enhancer, characterized in that the capacitive coupling is constituted by a metal curl surrounding the wall of ceramic material of the UV enhancer in a plane traverse to the longitudinal axis of the UV enhancer and being situated in the proximity of the extremity of the enhancer electrode within the UV enhancer.

2. A lamp as claimed in claim 1, characterized in that the distance between the extremity of the enhancer electrode within the UV enhancer and the plane in which the metal curl is situated is at most equal to the external diameter of the UV enhancer.

3. A lamp as claimed in claim 1 characterized in that the UV enhancer has a wall of densely sintered polycrystalline aluminum oxide.

4. A lamp as claimed in claim 1, in which the enhancer electrode has a lead-through at a first extremity of the UV enhancer, characterized in that the extremity of the enhancer electrode within the UV enhancer is spaced apart from the first extremity of the UV enhancer by a distance which is at least equal to twice the external diameter of the UV enhancer.

5. A lamp as claimed in claim 1 characterized in that the UV enhancer has a rare gas filling, preferably a rare gas filling comprising argon.

6. A lamp as claimed in claim 5, characterized in that the rare gas filling has a filling pressure of between 50 and 300 mbar.

7. A lamp as claimed in claim 1 characterized in that the UV enhancer is situated in the proximity of a lamp electrode, with its longitudinal axis being substantially parallel to the longitudinal axis of the lamp.

* * * * *